US008172648B2

(12) United States Patent
Lefevre et al.

(10) Patent No.: US 8,172,648 B2
(45) Date of Patent: May 8, 2012

(54) CHEMICAL-MECHANICAL PLANARIZATION PAD

(75) Inventors: Paul Lefevre, Topsfield, MA (US); Oscar K. Hsu, Chelmsford, MA (US); Marc C. Jin, Boston, MA (US); John Erik Aldeborgh, Boxford, MA (US); David Adam Wells, Hudson, NH (US)

(73) Assignee: Innopad, Inc., Wilmington, MA (US)

( * ) Notice: Subject to any disclaimer, the term of this patent is extended or adjusted under 35 U.S.C. 154(b) by 561 days.

(21) Appl. No.: 12/347,734

(22) Filed: Dec. 31, 2008

(65) Prior Publication Data

US 2009/0170410 A1 Jul. 2, 2009

Related U.S. Application Data

(60) Provisional application No. 61/017,872, filed on Dec. 31, 2007.

(51) Int. Cl.
*B24B 1/00* (2006.01)
*B24D 11/00* (2006.01)

(52) U.S. Cl. ..... 451/59; 451/532

(58) Field of Classification Search ..... 451/41, 451/59, 526, 532, 527, 533, 539; 51/293
See application file for complete search history.

(56) References Cited

U.S. PATENT DOCUMENTS

| | | | | |
|---|---|---|---|---|
| 5,759,917 | A | 6/1998 | Grover et al. | |
| 5,958,288 | A | 9/1999 | Mueller et al. | |
| 6,503,418 | B2 | 1/2003 | Sahota et al. | |
| 6,890,244 | B2 * | 5/2005 | Hsu et al. | 451/41 |
| 7,011,574 | B2 * | 3/2006 | Simpson et al. | 451/526 |
| 2003/0068960 | A1 * | 4/2003 | Reinhardt et al. | 451/41 |
| 2004/0053007 | A1 * | 3/2004 | Huh et al. | 428/158 |
| 2005/0133363 | A1 | 6/2005 | Hu et al. | |
| 2005/0153643 | A1 | 7/2005 | Simpson et al. | |
| 2007/0202702 | A1 | 8/2007 | Fu Chen et al. | |
| 2007/0224806 | A1 | 9/2007 | Yamashita | |

OTHER PUBLICATIONS

International Search Report and Written Opinion dated Feb. 23, 2009 in International Patent Application No. PCT/US08/88669.

* cited by examiner

*Primary Examiner* — Hadi Shakeri
(74) *Attorney, Agent, or Firm* — Grossman, Tucker, Perreault & Pfleger, PLLC

(57) ABSTRACT

The present disclosure relates to a polishing pad including a chemical agent present in an amount sufficient to be released and dissolving into an aqueous abrasive particle polishing medium during chemical mechanical planarization and reducing abrasive particle agglomeration and a binder. The pad includes a surface such that as the pad is abraded the surface is renewed exposing at least a portion of the chemical agent.

16 Claims, 2 Drawing Sheets

CHEMICAL-MECHANICAL PLANARIZATION PAD

CROSS-REFERENCE TO RELATED APPLICATIONS

This application claims the benefit of U.S. Provisional Patent Application Ser. No. 61/017,872, filed on Dec. 31, 2007, which is fully incorporated herein by reference.

FIELD OF INVENTION

The present invention relates to a chemical-mechanical planarization pad and, in particular, a chemical-mechanical planarization pad incorporating chemical agents.

BACKGROUND

Various chemicals are used in chemical-mechanical planarization (CMP) to enhance, stabilize and control the process of planarizing semiconductor substrates. Oxidizing agents such as hydrogen peroxide and monopersulfates may be used with ferric nitrate in the presence of an abrasive for CMP applications on metal polish. Alkaline solutions such as potassium hydroxide and ammonium hydroxide may used to hydrolyze the silicon dioxide layer in a semiconductor wafer to facilitate mechanical abrasion and removal. In addition, carboxylic acid, nitrate salt and soluble cerium may be used to affect high removal rate of a silicon dioxide film and slow removal rate of the underlying silicon nitride film thus preventing erosion of the silicon nitride film.

Other classes of chemicals used in CMP may include surfactants and corrosion inhibitors. Polyvinyl alcohol (PVOH), for example, may be added for stabilizing abrasive particles thus preventing their agglomeration. Polyethylene glycol and sodium dodecylbenzenesulfone may likewise be utilized as a dispersant. Furthermore, triazole compounds, may be used as corrosion inhibitors in copper polish.

SUMMARY

An aspect of the present disclosure relates to a polishing pad. The polishing pad may include a binder and a chemical agent, which chemical agent is present in an amount sufficient to be released and dissolving into an aqueous abrasive particle polishing medium during chemical mechanical planarization and reducing abrasive particle agglomeration. The pad may also include a surface and as the pad is abraded, the surface may be renewed exposing at least a portion of the chemical agent.

A further aspect of the present disclosure relates to a method of forming a polishing pad. The method may include combining a chemical agent into a binder wherein the chemical agent is present in an amount sufficient to be released and dissolve into an aqueous abrasive particle polishing medium during chemical mechanical planarization and reducing abrasive particle agglomeration. In addition, the method may include forming the binder and chemical agent into a chemical mechanical planarization polishing pad.

Yet a further aspect of the present disclosure relates to a method of polishing with a polishing pad. The method may include contacting a polishing pad having a surface with a substrate. The pad may include a chemical agent combined into a binder wherein the chemical agent may be present in an amount sufficient to be released and dissolve into an aqueous abrasive particle polishing medium during chemical mechanical planarization and reducing abrasive particle agglomeration. The method may also include abrading the pad and exposing at least a portion of the chemical agent.

BRIEF DESCRIPTION OF DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

The present invention relates to a CMP pad and its method of use via the aspect of incorporating one or more organic chemicals and/or polymers into the CMP pad for releasing into the polishing medium during chemical mechanical polishing. Such release may then enhance, stabilize and/or control the process of planarization of semiconductor substrates.

Various chemical agents, including but not limited to those mentioned herein, may be incorporated into a CMP pad. The incorporation of the chemical agents in the CMP pad may be achieved through dispersion of the agent in liquid or solid particle form in the pad material during manufacture. In addition, the agent may be applied to one or more of the individual components of the pad prior to pad manufacture.

Figure 1:
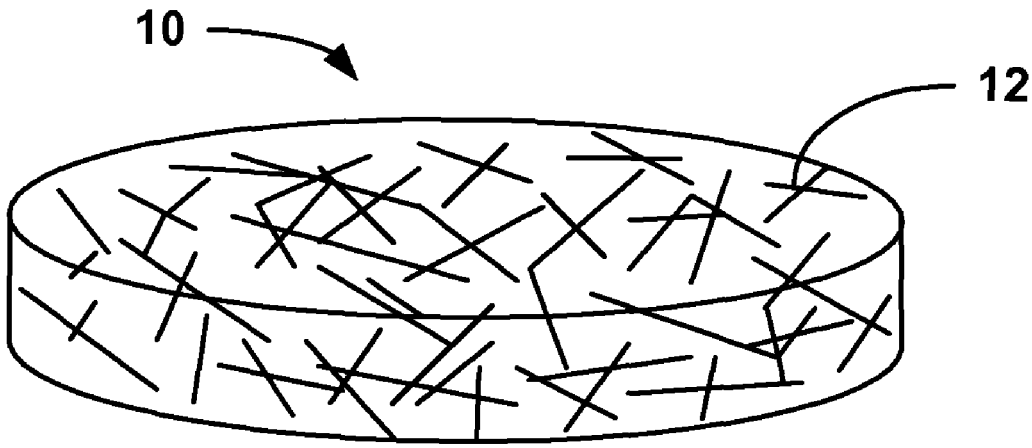
FIG. 1 illustrates an example of a CMP pad contemplated herein.

One example of a CMP pad, illustrated in FIG. 1, may include coating a chemical agent known as polyvinyl alcohol (PVOH) onto the surface of a three-dimensional network of polymeric fibers 12 (component 1), before mixing component 1 with a binder resin such as polyurethane pre-polymer (component 2) to form a CMP pad 10. It may be appreciated herein that the poly(vinyl alcohol) may be selected with varying levels of alcohol (—OH) functionality, i.e., percentage of hydrolysis, and/or varying molecular weights (number average), thereby presenting varying levels of solubility in, e.g., aqueous based polishing media. In some examples, the poly (vinyl alcohol) may exhibit greater than 50% hydrolysis of the poly(vinyl acetate) precursor, including all values and increments in the range of 50 to 99.9% hydrolysis, such as 75% to 99.9% hydrolysis, etc. In addition, the molecular weight may vary in the range of 10,000 to 500,000, including all values and increments therein, such as 100,000 to 300,000, etc. The coated polymeric fibers may then be mixed in the polyurethane pre-polymer during the manufacturing process. The polymeric fibers 12 may include soluble or insoluble fibers, which may be coated with polyvinyl alcohol during the fiber forming process or after the fiber forming process. Solublity may be understood as the ability of the fibers to at least partially or completely dissolve in an aqueous solution.

As alluded to above, during processing, the polyvinyl alcohol coating on the fibers may then be dissolved and dispersed in a given aqueous abrasive medium during CMP to prevent and/or reduce the agglomeration of the abrasive particles, which may reduce scratching defects on the semiconductor wafer. In addition, it may be appreciated that where the fibers themselves are soluble or made selectively soluble in a given slurry environment, the fibers may also dissolve upon exposure to the aqueous abrasive medium. The rate of release of the polyvinyl alcohol into the aqueous abrasive medium may be controlled, if desired, by the amount of coating, thickness of the coating and/or coating weight and/or the number of fibers exposed on the pad surface during CMP. This may be the case as the polyvinyl alcohol may only dissolve into the aqueous abrasive medium upon exposure to such medium.

Figure 2:
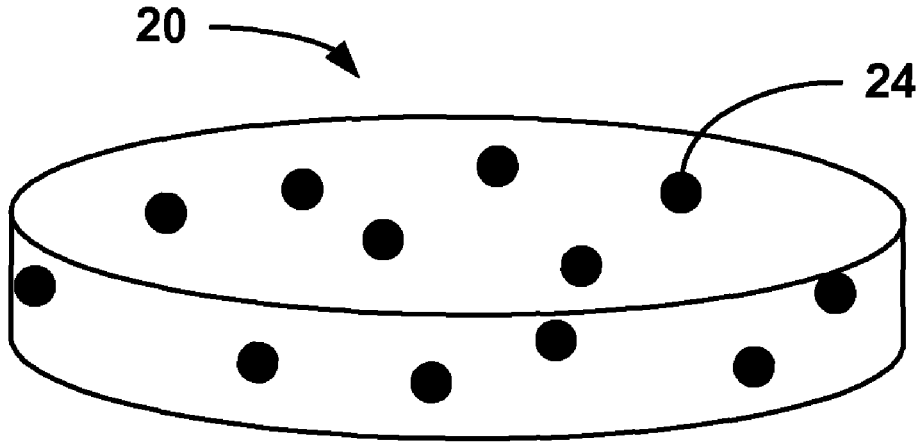
FIG. 2 illustrates another example of a CMP pad contemplated herein.

Another example of a CMP pad, illustrated in FIG. 2, may include mixing polyvinyl alcohol in liquid or particle form into component 2, the polyurethane pre-polymer. As illustrated, the polyvinyl alcohol may form discrete domains 24 within the CMP pad 20. During processing of the pad, the exposed polyvinyl alcohol on the pad surface may be dissolved, while the remaining unexposed polyvinyl alcohol may be kept within the bulk of the pad. As the pad is abraded during the CMP process, fresh surfaces may be exposed. Thus new or previously un-exposed polyvinyl alcohol may be dissolved and released into the aqueous abrasive medium. As in the above embodiment, the release of the polyvinyl alcohol may be controlled by the amount of the polyvinyl alcohol mixed into component 2 and the wear or abrasion rate of the pad.

Figure 3:
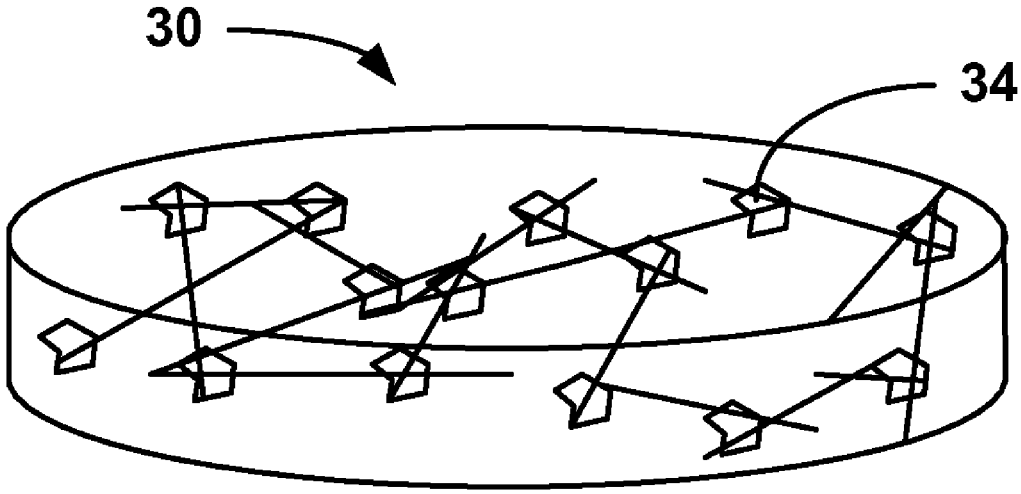
FIG. 3 illustrates a further example of a CMP pad contemplated herein.

A third example, illustrated in FIG. 3, may include using polyvinyl alcohol as the only ingredient to provide component 1. A three-dimensional network of polyvinyl alcohol fibers and/or particles 34 of polyvinyl alcohol may then be mixed with component 2 (described above) in the CMP pad 30 during the manufacturing process. Again, the rates of dissolution and release of polyvinyl alcohol may be controlled by the size of the three-dimensional network or weight of the polyvinyl alcohol particles in the pad.

It may be appreciated that in additional embodiments the chemical agents incorporated into a CMP pad may not have to dissolve and release into the aqueous abrasive medium. One or more chemical agents may therefore be maintained as relatively captive or stationary on the pad surface during CMP procedures. Such agents may also play a beneficial role to CMP performance. For example, a captive or stationary chemical agent on a pad surface may be utilized to impart a desired level of hydrophilicity or hydrophobicity to the pad surface. Hydrophilicity or hydrophobicity may be understood as the affinity of a substance to water, which may be indicated by, for example, the contact angle of water on a surface. In some examples, a contact angle of greater than 90° may indicate a relatively hydrophobic material and contact angles of 90° or less may indicate a relatively hydrophilic material.

An example of imparting hydrophilicity or hydrophobicity to the pad surface may include incorporating a surface wetting agent such as an organic ester of a carboxylic acid, such as an organic ester of stearic acid, which may provide hydrophilicity to the pad and facilitate contact between the aqueous abrasive medium, the pad and the semiconductor. Various methods may be used to incorporate such a hydrophilic or hydrophobic chemical agent into a CMP pad, including, but not limited to, chemical and/or irradiation grafting, and/or mixing a hydrophilic or hydrophobic chemical agent into one or more components of the pad.

In addition, as noted above oxidizing agents such as hydrogen peroxide and monopersulfates may be used with ferric nitrate in the presence of an abrasive for CMP applications on metal polish. Alkaline solutions such as potassium hydroxide and ammonium hydroxide may used to hydrolyze the silicon dioxide layer in a semiconductor wafer to facilitate mechanical abrasion and removal. In addition, carboxylic acid, nitrate salt and soluble cerium may be used to affect high removal rate of a silicon dioxide film and slow removal rate of the underlying silicon nitride film thus preventing erosion of the silicon nitride film.

Other classes of chemicals used in CMP may include surfactants and corrosion inhibitors. Polyvinyl alcohol (PVOH), for example, may be added for stabilizing abrasive particles thus preventing their agglomeration. Polyethylene glycol and sodium dodecylbenzenesulfone may likewise be utilized as a dispersant. Furthermore, triazole compounds, may be used as corrosion inhibitors in copper polish.

The chemical agents herein may be present in a range of about 0.1 to 50.0% by volume of the CMP pad, including all values and increments therein in 1.0% increments. In addition, the chemical agents may be localized to certain regions of the pad to provide a localized relative concentration. For example, the chemical agent may be provided to a core portion of the pad and/or to outer regions of the pad. Furthermore, the chemical agents may be dispersed relatively uniformly throughout the pad, wherein a given and relatively constant volume fraction of the chemical agent may be present throughout.

The method of use of the CMP pad in polishing a semiconductor substrate in the presence of an abrasive-containing or abrasive-free liquid medium may include placing the semiconductor substrate, pad and liquid medium in CMP polishing equipment. The polishing equipment may control one or more process parameters such as polishing time, pressure, temperature, relative speed of the pad on the substrate and flow rate of the liquid medium, etc. The results of CMP processes may be expressed in terms of polish or removal rate, uniformity of removal throughout the substrate surface (Within-Wafer-Non-Uniformity, WIWNU), planarity (Planarization Efficiency), Defectivity on the substrate surface, and useful life of the CMP pad.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

The invention claimed is:

1. A polishing pad, comprising:

a chemical agent at a molecular weight of 10,000 to 500,000 present in an amount sufficient to be released and dissolving into an aqueous abrasive particle polishing medium during chemical mechanical planarization and reducing abrasive particle agglomeration;

a binder, formed into the pad, wherein said pad includes a surface and wherein as said pad is abraded, the surface is renewed exposing at least a portion of said chemical agent;

wherein said chemical agent is coated on fibers;

wherein the fibers comprise fibers soluble in the aqueous abrasive particle polishing medium during chemical mechanical planarization;

wherein said chemical agent comprises polyvinyl alcohol sourced from polyvinyl acetate and exhibits greater than 50% hydrolysis of said polyvinyl acetate precursor wherein said polyvinyl alcohol is present in a range of 0.1 to 50.0% by volume of said pad.

2. The polishing pad of claim 1 wherein the chemical agent forms a three-dimensional network within the pad.

3. The polishing pad of claim 1, wherein said fibers further comprise fibers insoluble in the aqueous abrasive particle polishing medium during chemical mechanical planarization.

4. The polishing pad of claim 1, wherein said chemical agent further comprises particles dispersed within said pad.

5. The polishing pad of claim 1, including a second chemical agent that does not dissolve in said aqueous abrasive particle polishing medium and wherein said second chemical agent imparts a desired level of hydrophobicity or hydrophilicity to said pad surface.

6. The polishing pad of claim 1, wherein said chemical agent is localized to a region of the pad providing a localized relative concentration.

7. The polishing pad of claim 1, including a dispersant comprising one of polyethylene glycol and sodium dodecylbenzenesulfone.

8. A method of forming a polishing pad, comprising:

combining a chemical agent into a binder wherein said chemical agent has a molecular weight of 10,000 to 500,000 and is present in an amount sufficient to be released and dissolve into an aqueous abrasive particle polishing medium during chemical mechanical planarization and reducing abrasive particle agglomeration, wherein said chemical agent is coated on fibers and the fibers comprise fibers soluble in the aqueous abrasive particle polishing medium during chemical mechanical planarization, wherein said chemical agent comprises polyvinyl alcohol sourced from polyvinyl acetate and exhibits greater than 50% hydrolysis of said polyvinyl acetate precursor wherein said polyvinyl alcohol is present in a range of 0.1 to 50.0% by volume of said pad; and forming said binder and chemical agent into a chemical mechanical planarization polishing pad.

9. The method of claim 8 wherein the chemical agent forms a three-dimensional network within the pad.

10. The method of claim 8, wherein said fibers further comprise fibers insoluble in the aqueous abrasive particle polishing medium during chemical mechanical planarization.

11. The method of claim 8, wherein said chemical agent further comprises particles dispersed within said pad.

12. The method of claim 8, including a second chemical agent that does not dissolve in said aqueous abrasive particle polishing medium and wherein said second chemical agent imparts a desired level of hydrophobicity or hydrophilicity to said pad surface.

13. The method of claim 8, wherein said chemical agent is localized to a region of the pad providing a localized relative concentration.

14. The method of claim 8, wherein said polishing pad includes a dispersant comprising one of polyethylene glycol and sodium dodecylbenzenesulfone.

15. A method of polishing with a polishing pad, comprising:

providing a pad comprising a chemical agent combined into a binder wherein said chemical agent has a molecular weight of 10,000 to 500,000 and is present in an amount sufficient to be released and dissolve into an aqueous abrasive particle polishing medium during chemical mechanical planarization and reducing abrasive particle agglomeration, wherein said chemical agent is coated on fibers and the fibers comprise fibers soluble in the aqueous abrasive particle polishing medium during chemical mechanical planarization, wherein said chemical agent comprises polyvinyl alcohol sourced from polyvinyl acetate and exhibits greater than 50% hydrolysis of said polyvinyl acetate precursor wherein said polyvinyl alcohol is present in a range of 0.1 to 50.0% by volume of said pad;

contacting a surface of said polishing pad with a substrate;

abrading said pad and exposing at least a portion of said chemical agent and said fibers;

dissolving the exposed portion of said chemical agent and said fibers in the aqueous abrasive particle polishing medium during chemical mechanical planarization.

16. The method of claim 15, wherein said polishing pad includes a dispersant comprising one of polyethylene glycol and sodium dodecylbenzenesulfone.

* * * * *